US011778376B2

(12) United States Patent
Lee et al.

(10) Patent No.: US 11,778,376 B2
(45) Date of Patent: Oct. 3, 2023

(54) APPARATUS AND METHOD FOR PITCH-SHIFTING AUDIO SIGNAL WITH LOW COMPLEXITY

(71) Applicant: ELECTRONICS AND TELECOMMUNICATIONS RESEARCH INSTITUTE, Daejeon (KR)

(72) Inventors: Yong Ju Lee, Daejeon (KR); Jae-hyoun Yoo, Daejeon (KR); Dae Young Jang, Daejeon (KR); Kyeongok Kang, Daejeon (KR); Tae Jin Lee, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 14 days.

(21) Appl. No.: 17/582,209

(22) Filed: Jan. 24, 2022

(65) Prior Publication Data

US 2023/0112342 A1 Apr. 13, 2023

(30) Foreign Application Priority Data

Sep. 29, 2021 (KR) ..... 10-2021-0128528

(51) Int. Cl.
*H04R 5/02* (2006.01)
*G10H 1/20* (2006.01)
*H04R 3/04* (2006.01)

(52) U.S. Cl.
CPC ... *H04R 3/04* (2013.01); *G10H 1/20* (2013.01)

(58) Field of Classification Search
CPC ..... H04R 3/04; G10H 1/20
USPC ..... 381/309, 310
See application file for complete search history.

(56) References Cited

U.S. PATENT DOCUMENTS

| | | | | |
|---|---|---|---|---|
| 5,644,677 | A | 7/1997 | Park et al. | |
| 6,046,395 | A | 4/2000 | Gibson et al. | |
| 9,805,716 | B2 | 10/2017 | Lee et al. | |
| 2013/0142338 | A1* | 6/2013 | Chang et al. ..... | H04S 5/005 381/17 |
| 2013/0191134 | A1 | 7/2013 | Lee | |

FOREIGN PATENT DOCUMENTS

| | | | |
|---|---|---|---|
| JP | 2004151229 | A | 5/2004 |
| JP | 2018117341 | A | 7/2018 |
| KR | 20190028706 | A | 3/2019 |
| WO | 2015065850 | A3 | 7/2015 |

OTHER PUBLICATIONS

"Resonance Audio", Website <https://resonance-audio.github.io/resonance-audio/discover/overview>.

"What is Project Acoustics?", Web page <https://docs.microsoft.com/en-us/gaming/acoustics/what-is-acoustics>, Article, Apr. 27, 2021.

Joe Berkovitz et al., "Web Audio Processing: Use Cases and Requirements", W3CWorking Group Note Jan. 29, 2013.

* cited by examiner

*Primary Examiner* — Ammar T Hamid
(74) *Attorney, Agent, or Firm* — LRK PATENT LAW FIRM

(57) ABSTRACT

An apparatus and method for pitch-shifting an audio signal with low complexity are disclosed. The method includes identifying a distance between an audio object included in the audio signal and a listener, checking whether the distance between the audio object and the listener decreases, and performing stepwise stretching pitch-shifting of repeatedly using at least one of frequency components of the audio signal when the distance between the audio object and the listener decreases.

13 Claims, 11 Drawing Sheets

APPARATUS AND METHOD FOR PITCH-SHIFTING AUDIO SIGNAL WITH LOW COMPLEXITY

CROSS-REFERENCE TO RELATED APPLICATION

This application claims the benefit of Korean Patent Application No. 10-2021-0128528 filed on Sep. 29, 2021, in the Korean Intellectual Property Office, the entire disclosure of which is incorporated herein by reference for all purposes.

BACKGROUND

1. Field of the Invention

One or more example embodiments relate to a method for pitch-shifting an audio signal, and more particularly, to an apparatus and method for reducing computational complexity by performing stepwise pitch-shifting.

2. Description of Related Art

Audio services have changed from mono and stereo services to multi-channel services such as 9.1, 11.1, 10.2, 13.1, 15.1, and 22.2 channels including uplink channels through 5.1 and 7.1 channels.

With the development of audio services, one sound source is regarded as an object, and object-based audio service technology that stores, transmits, and plays audio object-related information such as an audio signal including an audio object and a position and size of the audio object has been also developed.

In this case, there is a pitch-shifting algorithm that occurs in the Doppler phenomenon during sound processing based on a moving speed of the audio object.

A conventional pitch-shifting algorithm performs time stretching on an audio signal, performs interpolation, and outputs a result of performing resampling. However, in case of time stretching or resampling, an algorithm is not complicated, but high computational complexity is required.

Accordingly, the use of the pitch-shifting algorithm may be limited according to a computing capability of a terminal of reproducing audio, and thus a pitch-shifting method with low computational complexity is being requested.

SUMMARY

Example embodiments provide an apparatus and method for reproducing the Doppler effect with low computational complexity by allowing an audio signal pitch-shifting apparatus 100 to perform stepwise stretching pitch-shifting or stepwise pull pitch-shifting according to a change in a distance between an audio object included in an audio signal and a listener.

According to an aspect, there is provided a method for pitch-shifting an audio signal, the method including identifying a distance between an audio object included in the audio signal and a listener, checking whether the distance between the audio object and the listener decreases, and performing stepwise stretching pitch-shifting of repeatedly using at least one of frequency components of the audio signal when the distance between the audio object and the listener decreases.

The performing of the stepwise stretching pitch-shifting may include deleting at least one of the frequency components of the audio signal according to the decreased distance between the audio object and the listener, determining a frequency component to be repeatedly used according to the number of deleted frequency components, and duplicating the frequency component to be used repeatedly and adding the duplicated frequency component.

The determining of the frequency component to be repeatedly used may include determining an interval between frequency components according to the number of the frequency components of the audio signal and the number of the deleted frequency components, and determining a frequency component to be repeatedly used from among the frequency components of the audio signal according to the interval between the frequency components.

According to another aspect, there is provided a method for pitch-shifting an audio signal, the method including identifying a distance between an audio object included in the audio signal and a listener, checking whether the distance between the audio object and the listener increases, and performing stepwise pull pitch-shifting of deleting at least one of frequency components of the audio signal when the distance between the audio object and the listener increases.

The performing of the stepwise pull pitch-shifting may include determining a frequency component to be deleted from the audio signal according to the distance between the audio object and the listener, and deleting the determined frequency component from the audio signal.

The determining of the frequency component to be deleted may include determining the number of frequency components to be deleted from the audio signal according to the increased distance between the audio object and the listener, determining an interval between frequency components according to the number of the frequency components of the audio signal and the number of the frequency components to be deleted, and determining a position of a frequency component to be deleted from among the frequency components of the audio signal according to the interval between the frequency components.

The deleting of the frequency component may include deleting a frequency component corresponding to a position of the frequency component from among the frequency components of the audio signal, and moving frequency components positioned at a right side of the position of the frequency component from among the frequency components of the audio signal to a left side of the position of the frequency component.

According to still another aspect, there is provided an apparatus for pitch-shifting an audio signal, the apparatus including a distance identifier configured to identify a distance between an audio object included in the audio signal and a listener, a change identifier configured to identify whether the distance between the audio object and the listener changes, a stretching pitch shifter configured to perform stepwise stretching pitch-shifting of repeatedly using at least one of frequency components of the audio signal when the distance between the audio object and the listener decreases, and a pull pitch shifter configured to perform stepwise pull pitch-shifting of deleting at least one of the frequency components of the audio signal when the distance between the audio object and the listener increases.

The stretching pitch shifter may be configured to delete at least one of the frequency components of the audio signal according to the decreased distance between the audio object and the listener, determine a frequency component to be repeatedly used according to the number of deleted frequency components, and duplicate the determined frequency component and add the duplicated frequency component to the audio signal.

The stretching pitch shifter may be configured to determine an interval between frequency components according to the number of the frequency components of the audio signal and the number of the deleted frequency components, and determine a frequency component to be repeatedly used from among the frequency components of the audio signal according to the interval between the frequency components.

The pull pitch shifter is configured to decrease an overall bandwidth of the audio signal according to the increased distance between the audio object and the listener, determine a frequency component to be deleted from the audio signal according to the distance between the audio object and the listener, and delete the determined frequency component from the audio signal.

The pull pitch shifter may be configured to determine the number of frequency components to be deleted from the audio signal according to the increased distance between the audio object and the listener, determine an interval between frequency components according to the number of the frequency components of the audio signal and the number of the frequency components to be deleted, and determine a position of a frequency component to be deleted from among the frequency components of the audio signal according to the interval between the frequency components.

The pull pitch shifter may be configured to delete a frequency component corresponding to a position of the frequency component from among the frequency components of the audio signal, and move frequency components positioned at a right side of the position of the frequency component from among the frequency components of the audio signal to a left side of the position of the frequency component.

Additional aspects of example embodiments will be set forth in part in the description which follows and, in part, will be apparent from the description, or may be learned by practice of the disclosure.

According to example embodiments, stepwise stretching pitch-shifting or stepwise pull pitch-shifting may be performed according to a change in a distance between an audio object included in an audio signal and a listener, thereby reproducing the Doppler effect with low computational complexity.

In addition, according to example embodiments, when at least one frequency component is deleted starting from a highest frequency component according to a height of a frequency component due to a decrease in the distance between the audio object and the listener, stepwise stretching pitch-shifting of repeatedly using at least one of frequency components of the audio signal may be performed, thereby maintaining the number of the frequency components of the audio signal.

In addition, according to example embodiments, when an overall bandwidth of the audio signal decreases due to an increase in the distance between the audio object and the listener, stepwise pull pitch-shifting of deleting at least one of the frequency components of the audio signal may be performed, thereby maintaining a bandwidth of each of the frequency components included in the audio signal.

BRIEF DESCRIPTION OF THE DRAWINGS

These and/or other aspects, features, and advantages of the invention will become apparent and more readily appreciated from the following description of example embodiments, taken in conjunction with the accompanying drawings of which.

DETAILED DESCRIPTION

Hereinafter, example embodiments will be described in detail with reference to the accompanying drawings. A method for pitch-shifting an audio signal and a method for audio decoding according to an example embodiment may be performed by an audio signal pitch-shifting apparatus 110 and an audio decoding apparatus 120.

Figure 1:
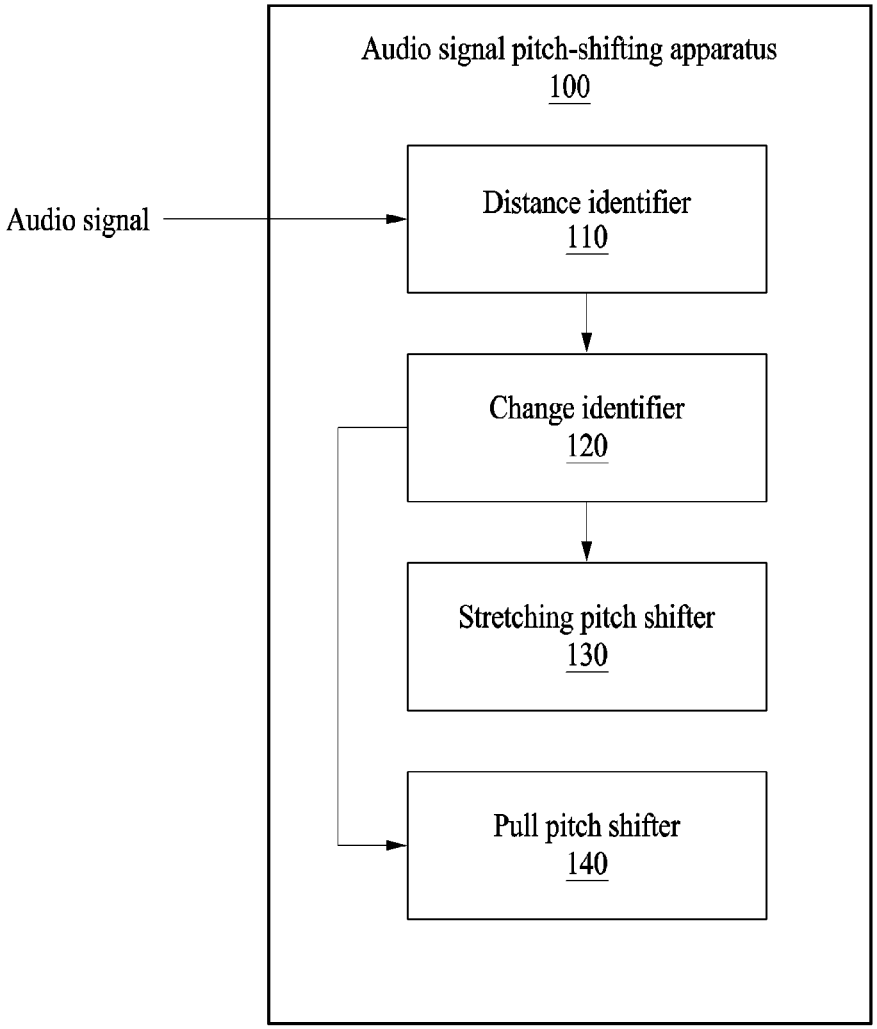
FIG. 1 is a diagram illustrating an apparatus for pitch-shifting an audio signal according to an example embodiment.

FIG. 1 is a diagram illustrating an apparatus for pitch-shifting an audio signal according to an example embodiment.

An audio signal pitch-shifting apparatus 100 may include a distance identifier 110, a change identifier 120, a stretching pitch shifter 130, and a pull pitch shifter 140, as illustrated in FIG. 1. In this case, the distance identifier 110, the change identifier 120, the stretching pitch shifter 130, and the pull pitch shifter 140 may be different processes or respective modules included in one process.

The change identifier 120 may identify a distance between an audio object included in an audio signal and a listener.

The change identifier 120 may identify whether the distance between the audio object and the listener identified by the distance identifier 110 changes. When the distance between the audio object and the listener changes, the change identifier 120 may check whether the distance between the audio object and the listener increases or the distance between the audio object and the listener decreases. When the distance between the audio object and the listener decreases, the change identifier 120 may request the stretching pitch shifter 130 to perform pitch-shifting. In addition, when the distance between the audio object and the listener increases, the change identifier 120 may request the pull pitch shifter 130 to perform pitch-shifting.

The stretching pitch shifter 130 may perform stepwise stretching pitch-shifting of repeatedly using at least one of frequency components of the audio signal.

Specifically, the stretching pitch shifter 130 may delete at least one of the frequency components of the audio signal according to the decreased distance between the audio object and the listener.

Subsequently, the stretching pitch shifter 130 may determine a frequency component to be repeatedly used according to the number of deleted frequency components. In this case, the stretching pitch shifter 130 may determine an interval between frequency components according to the number of the frequency components of the audio signal and the number of the deleted frequency components. In addition, the stretching pitch shifter 130 may determine a frequency component to be repeatedly used from among the frequency components of the audio signal according to the interval between the frequency components.

Subsequently, the stretching pitch shifter 130 may duplicate the frequency component to be used repeatedly, and add the duplicated frequency component.

The pull pitch shifter 140 may perform stepwise pull pitch-shifting of deleting at least one of the frequency components of the audio signal.

Specifically, the pull pitch shifter 140 may determine a frequency component to be deleted from the audio signal according to the distance between the audio object and the listener. In this case, the pull pitch shifter 140 may determine the number of frequency components to be deleted from the audio signal according to the increased distance between the audio object and the listener. In addition, the pull pitch shifter 140 may determine an interval between frequency components according to the number of the frequency components of the audio signal and the number of the frequency components to be deleted. Finally, the pull pitch shifter 140 may determine a position of a frequency component to be deleted from among the frequency components of the audio signal according to the interval between the frequency components.

Subsequently, the pull pitch shifter 140 may delete the determined frequency component from the audio signal. In this case, the pull pitch shifter 140 may delete a frequency component corresponding to the position of the frequency component from among the frequency components of the audio signal. In addition, the pull pitch shifter 140 may move frequency components positioned at a right side of the position of the frequency component among the frequency components of the audio signal to a left side of the position of the frequency component.

The audio signal pitch-shifting apparatus 100 may perform stepwise stretching pitch-shifting or stepwise pull pitch-shifting according to a change in the distance between the audio object included in the audio signal and the listener, thereby reproducing the Doppler effect with low computational complexity.

In addition, the audio signal pitch-shifting apparatus 100 may allow various terminals such as a six degrees of freedom (6DOF) audio rendering terminal and the like to reproduce the Doppler effect for a large number of audio objects in real time by reproducing the Doppler effect with low computational complexity.

Figure 2:
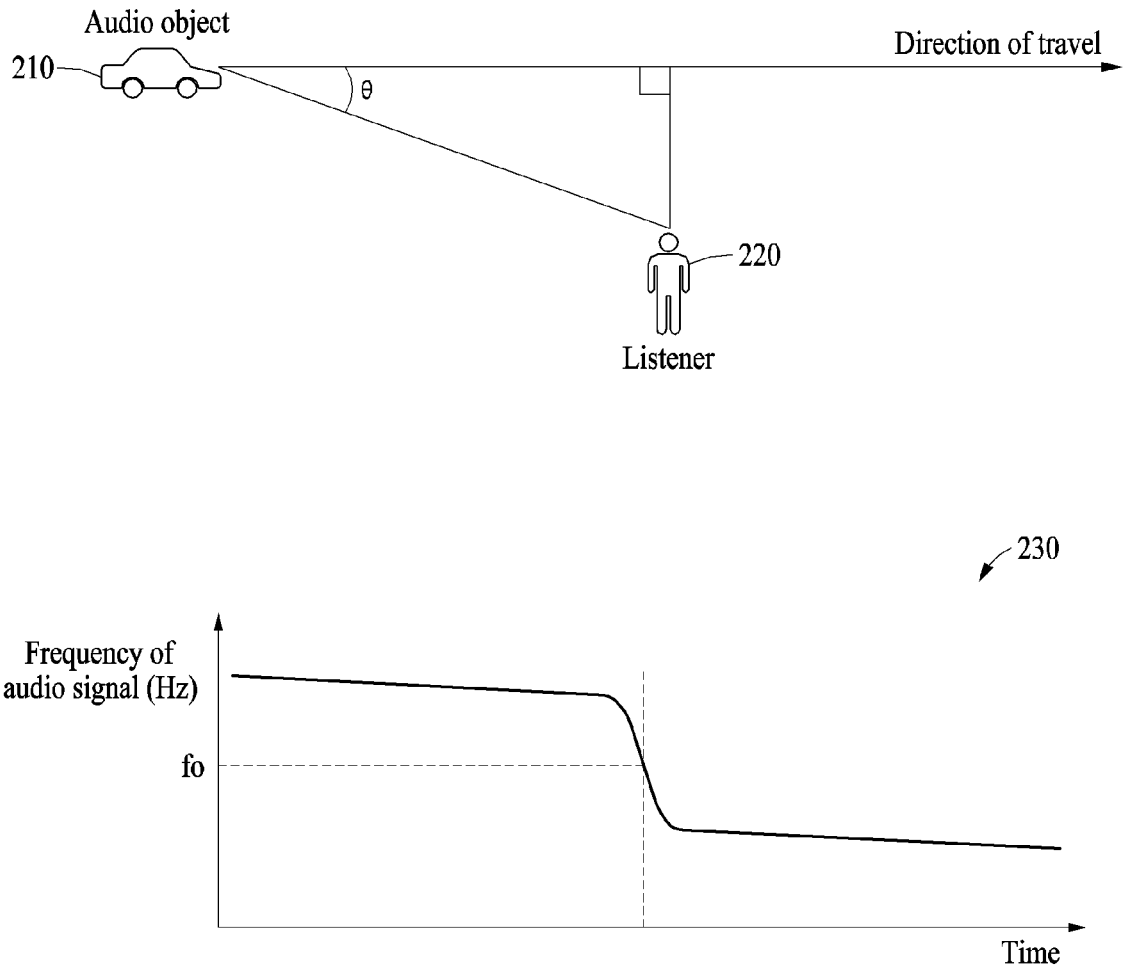
FIG. 2 is a diagram illustrating an example of a frequency change of an audio signal based on the Doppler effect.

FIG. 2 is a diagram illustrating an example of a frequency change of an audio signal based on the Doppler effect.

As the audio object 210 travels, a frequency 230 of an audio signal listened to by a listener 220 may change due to the Doppler effect, as illustrated in FIG. 2. Specifically, when the audio object 210 approaches the listener 220, the listener 220 may listen to an audio signal having a higher frequency than that of an original audio signal. Conversely, when the audio object 210 moves away from the listener 220, the listener 220 may listen to an audio signal having a lower frequency than that of the original audio signal.

Figure 3:
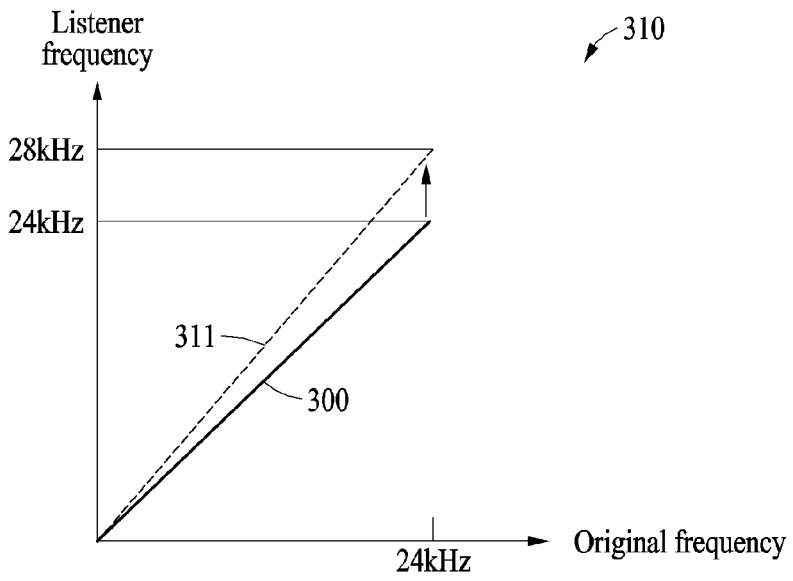
FIG. 3 is a diagram illustrating an example of an ideal frequency change based on pitch-shifting.
Figure 3:
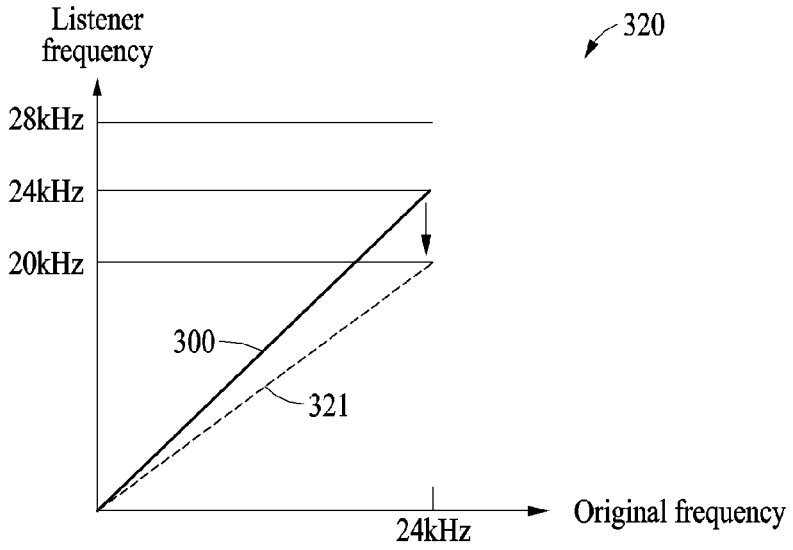

FIG. 3 is a diagram illustrating an example of an ideal frequency change based on pitch-shifting.

When a distance between an audio object and a listener decreases (case 310), an audio signal 311 listened to by the listener may be a signal in which a pitch of an original audio signal 300 is changed to have a higher frequency, as illustrated in FIG. 3.

In addition, when the distance between the audio object and the listener increases (case 320), an audio signal 321 listened to by the listener may be a signal in which the pitch of the original audio signal 300 is changed to have a lower frequency, as illustrated in FIG. 3.

In this case, the audio signal 311 and the audio signal 321 may be ideal in a form in which all frequencies increase or decrease at the same rate, and a slope thereof may change depending on a relative speed between the audio object and a user.

However, in order to change all frequencies at the same rate, an algorithm with high computational complexity such as "interpolation" or "resampling" may need to be performed.

Figure 4:
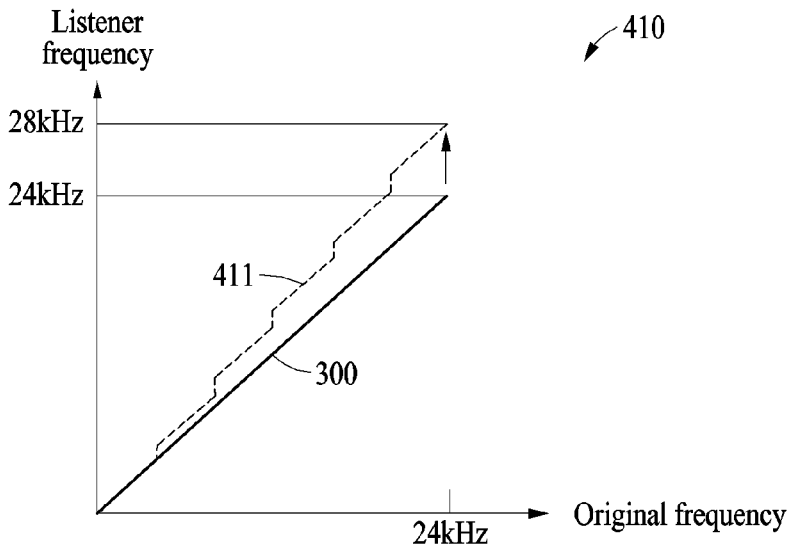
FIG. 4 is a diagram illustrating an example of a frequency change of an audio signal based on pitch-shifting according to an example embodiment.
Figure 4:
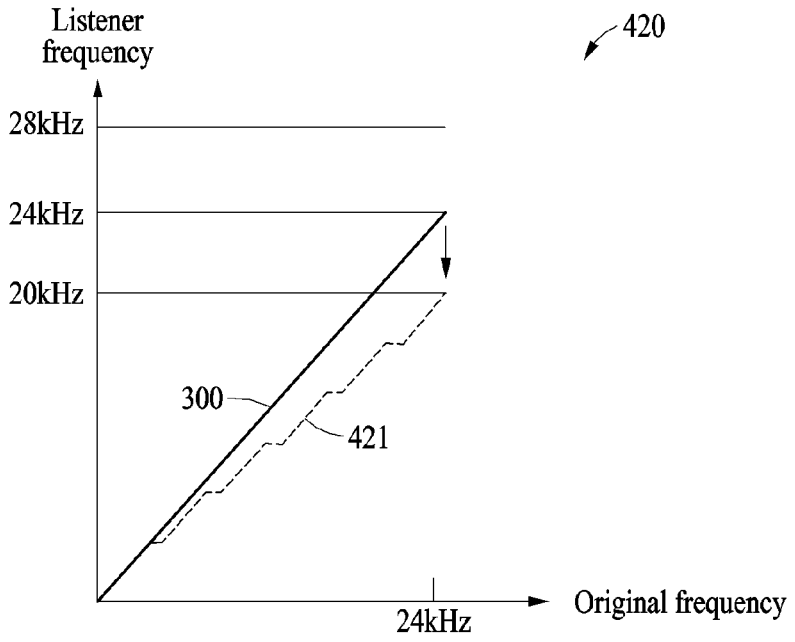

FIG. 4 is a diagram illustrating an example of a frequency change of an audio signal based on pitch-shifting according to an example embodiment.

When a distance between an audio object and a listener decreases (case 410), the audio signal pitch-shifting apparatus 100 may output an audio signal 411 in which a pitch of the original audio signal 300 is increased in a stepwise manner every predetermined section, as illustrated in FIG. 4.

In addition, when the distance between the audio object and the listener increases (case 420), the audio signal pitch-shifting apparatus 100 may output an audio signal 421 in which the pitch of the original audio signal 300 is decreased in a stepwise manner every predetermined section, as illustrated in FIG. 4.

The audio signal pitch-shifting apparatus 100 may perform pitch-shifting of increasing or decreasing in a stepwise manner, so that pitch-shifting may be possible without an algorithm with high computational complexity such as "interpolation" or "resampling", thereby reproducing the Doppler effect with low computational complexity.

Figure 5:
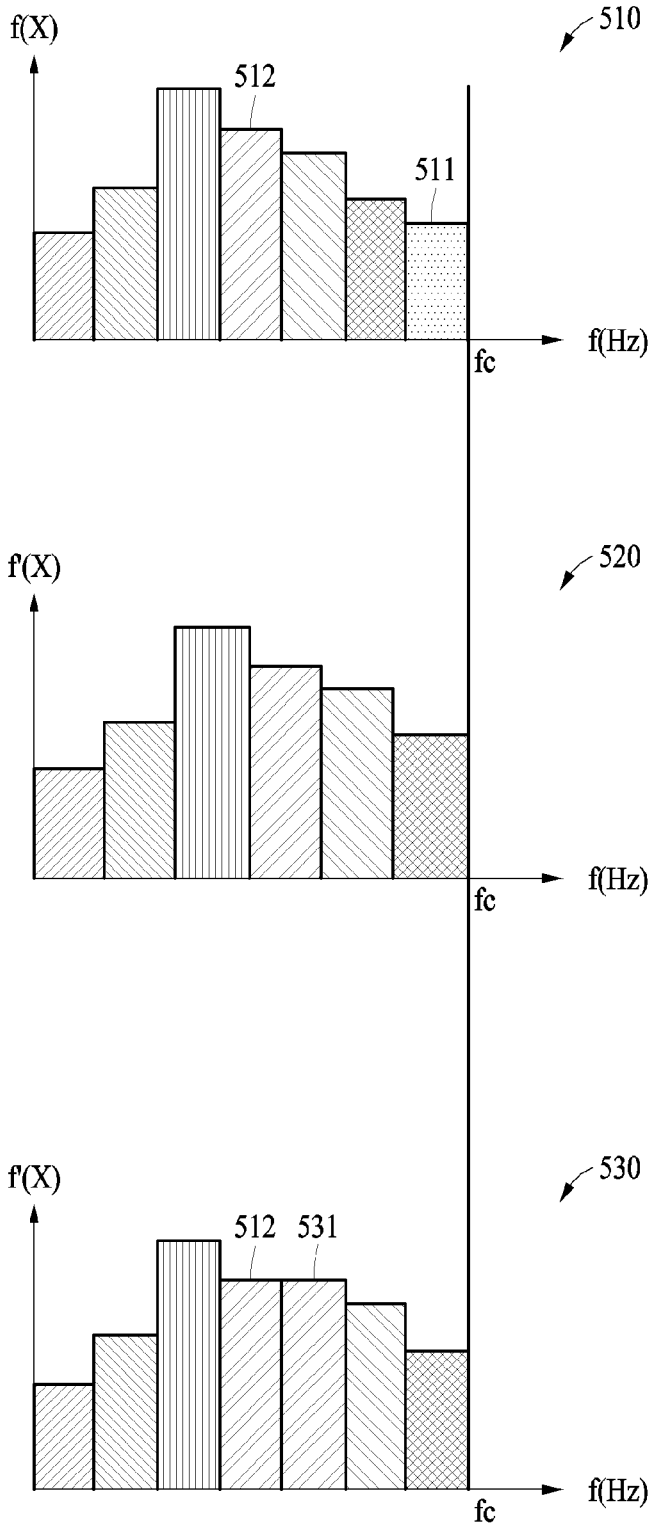
FIG. 5 is a diagram illustrating an example of a result of performing pitch-shifting according to an example embodiment, when a distance between an audio object and a listener decreases.

FIG. 5 is a diagram illustrating an example of a result of performing pitch-shifting according to an example embodiment, when a distance between an audio object and a listener decreases.

When an original audio signal 510 includes seven frequency components as illustrated in FIG. 5, and a distance between an audio object and a listener decreases, a conventional pitch-shifting apparatus may output an audio signal 520 having only six frequency components by deleting a highest frequency component 511 from among frequency components of the original audio signal 510. In this case, a bandwidth of each of the frequency components of the audio signal 520 may be expanded due to a decrease in the number of frequency components, and thus a frequency component having a frequency fb may be changed to have a frequency fc.

Conversely, the audio signal pitch-shifting apparatus 100 may delete the highest frequency component 511 from among the frequency components of the original audio signal 510, as illustrated in FIG. 5. However, the audio signal pitch-shifting apparatus 100 may output an audio signal 530 including seven frequency components by duplicating a frequency component 512 among the frequency components to add a frequency component 531. In this case, the audio signal 530 may have the same number of frequency components as those of the original audio signal 510, and thus a bandwidth of each of the frequency components included in the audio signal 530 may also be the same as a bandwidth of each of frequency signals included in the original audio signal 510.

That is, when at least one frequency component is deleted starting from a highest frequency component according to a height of a frequency component due to a decrease in the distance between the audio object and the listener, the audio signal pitch-shifting apparatus 100 according to an example embodiment may perform stepwise stretching pitch-shifting of repeatedly using at least one of frequency components of an audio signal, thereby maintaining the number of the frequency components included in the audio signal.

Figure 6:
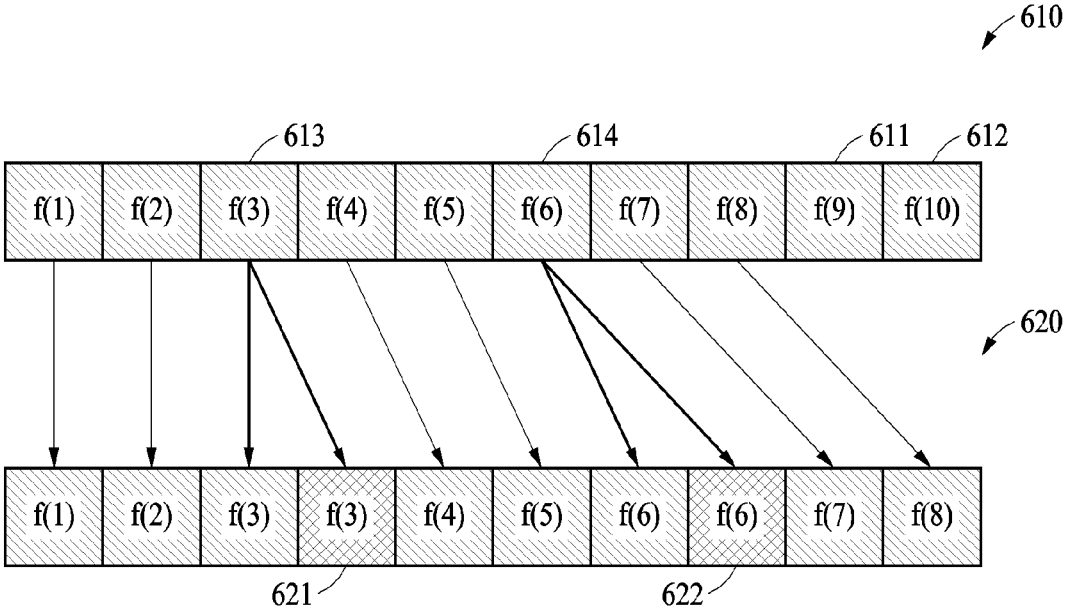
FIG. 6 is a diagram illustrating an example of a change process of a frequency component of an audio signal in the pitch-shifting process of FIG. 5.

FIG. 6 is a diagram illustrating an example of a change process of a frequency component of an audio signal in the pitch-shifting process of FIG. 5.

When the number of FFT points (frequency components) of an original audio signal 610 is 10, and a distance between an audio object and a listener decreases, the audio signal pitch-shifting apparatus 100 may delete two FFT points (frequency components) 611 and 612 according to a speed of the audio object.

In this case, the audio signal pitch-shifting apparatus 100 may determine a frequency component to be repeatedly used according to the number of the deleted frequency components. In this case, the audio signal pitch-shifting apparatus 100 may determine the same number as the number of the frequency components deleted according to the speed of the audio object as the number of frequency components to be repeatedly used. For example, the audio signal pitch-shifting apparatus 100 may determine 2 as the number of the frequency components to be repeatedly used.

In addition, the audio signal pitch-shifting apparatus 100 may determine an interval between frequency components according to the number of frequency components of the audio signal and the number of the deleted frequency components. For example, the audio signal pitch-shifting apparatus 100 may determine the interval between the frequency components using Equation 1.

[Equation 1]

$$\text{Frequency interval} = (\text{the number of FFT point (frequency components)}) / (\text{the number of frequency components to be repeatedly used} + 1)$$

For example, the audio signal pitch-shifting apparatus 100 may determine 10 / (2 + 1) = 3 as the interval between the frequency components in FIG. 6.

In addition, the audio signal pitch-shifting apparatus 100 may determine a frequency component to be repeatedly used from among the frequency components of the audio signal according to the interval between the frequency components. For example, the audio signal pitch-shifting apparatus 100 may determine a third frequency component 613 and a sixth frequency component 614 as f frequency components to be repeatedly used according to 3 which is the interval between the frequency component.

Finally, the audio signal pitch-shifting apparatus 100 may output an audio signal 620 in which the frequency component to be used repeatedly is duplicated and the duplicated frequency component is added.

In summary, the audio signal pitch-shifting apparatus 100 may delete two frequency components 611 and 612 from the original audio signal 610 according to a decrease in the distance between the audio object and the listener. Subsequently, the audio signal pitch-shifting apparatus 100 may determine 3, which is the interval between the frequency components, according to the number of the frequency components of the audio signal and the number of the deleted frequency components. Subsequently, the audio signal pitch-shifting apparatus 100 may determine the third frequency component 613 and the sixth frequency component 614 as the frequency components to be repeatedly used according to 3 which is the interval between the frequency components. Subsequently, the audio signal pitch-shifting apparatus 100 may output the audio signal 620 in which the third frequency component 613 is duplicated and a frequency component 621 is added after the third frequency component 613, and the sixth frequency component 614 is duplicated and a frequency component 622 is added after the sixth frequency component 614.

Figure 7:
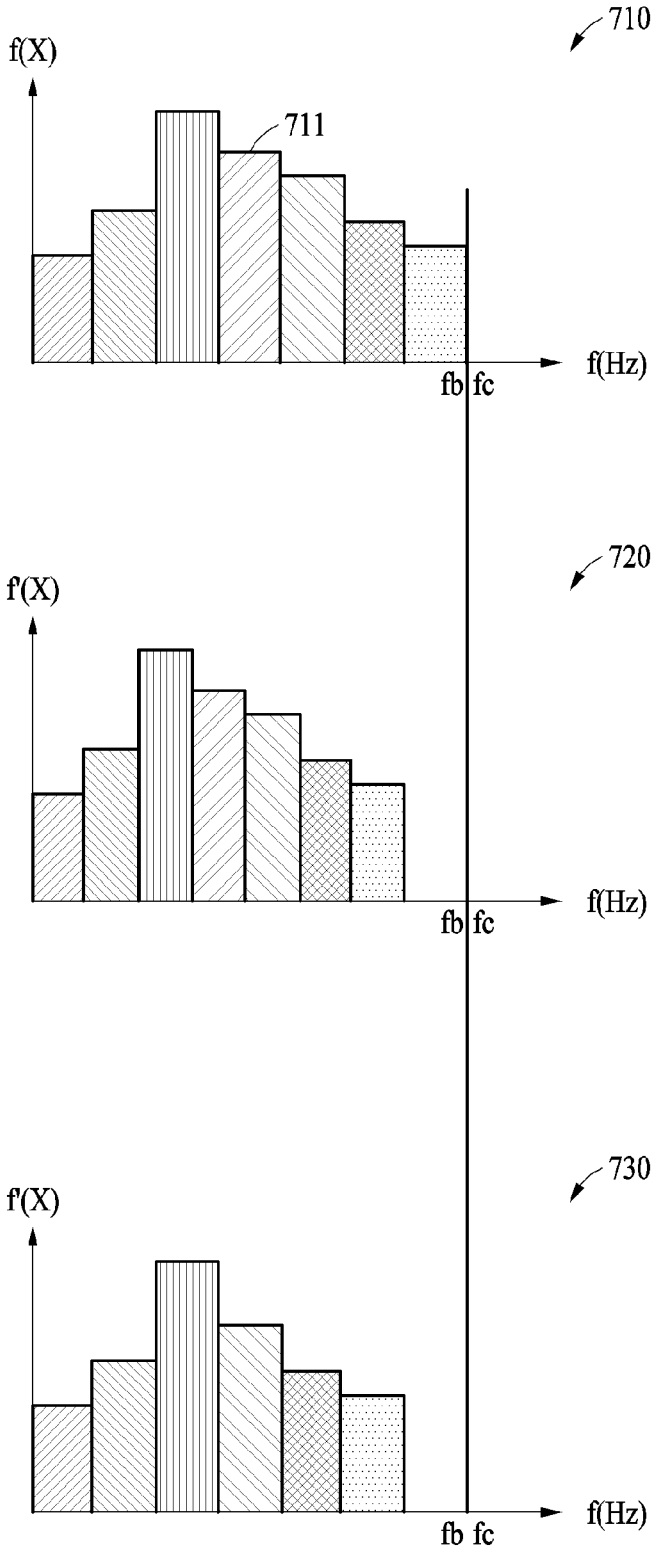
FIG. 7 is a diagram illustrating an example of a result of performing pitch-shifting according to an example embodiment, when a distance between an audio object and a listener increases.

FIG. 7 is a diagram illustrating an example of a result of performing pitch-shifting according to an example embodiment, when a distance between an audio object and a listener increases.

When an original audio signal 710 includes seven frequency components as illustrated in FIG. 7, and a distance between an audio object and a listener increases, a conventional pitch-shifting apparatus may decrease a bandwidth of each of the frequency components while maintaining the number of the frequency components of the original audio signal 710, thereby changing a highest frequency component from a frequency fb to a frequency fc.

Conversely, as illustrated in FIG. 7, the audio signal pitch-shifting apparatus 100 may delete a frequency component 711 from among the frequency components of the original audio signal 710, and move the other frequency components to a left side, thereby outputting an audio signal 730 including six frequency components, but each of the six frequency components having the same bandwidth as that of the original audio signal 710.

That is, when an overall bandwidth of an audio signal decreases due to an increase in the distance between the audio object and the listener, the audio signal pitch-shifting apparatus 100 according to an example embodiment may perform stepwise pull pitch-shifting of deleting at least one of frequency components of the audio signal, thereby maintaining a bandwidth of each of the frequency components included in the audio signal.

Figure 8:
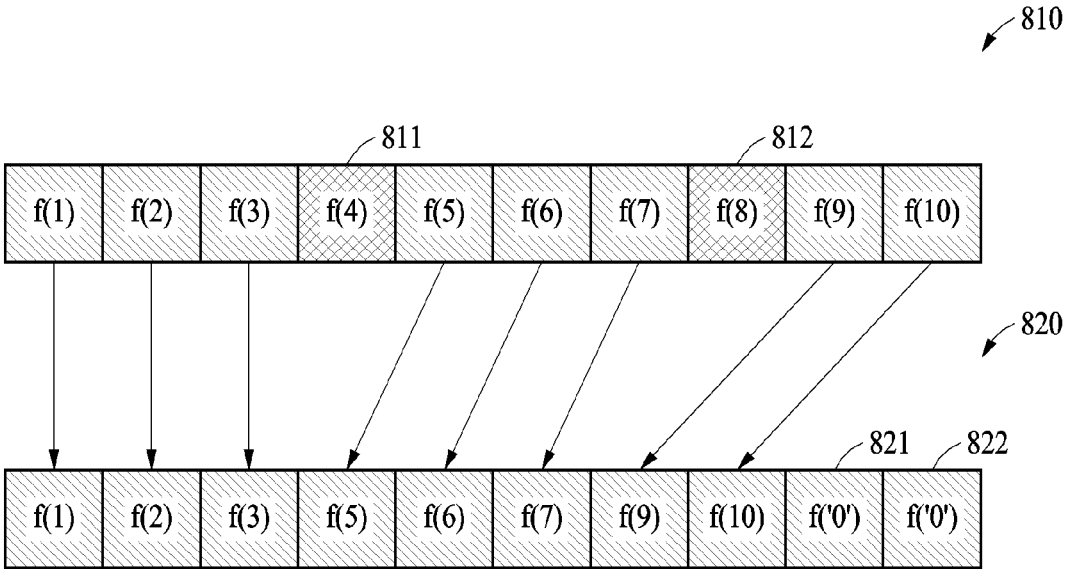
FIG. 8 is a diagram illustrating an example of a change process of a frequency component of an audio signal in the pitch-shifting process of FIG. 7.

FIG. 8 is a diagram illustrating an example of a change process of a frequency component of an audio signal in the pitch-shifting process of FIG. 7.

When the number of FFT points (frequency components) of an original audio signal 810 is 10, and a distance between an audio object and a listener increases, the audio signal pitch-shifting apparatus 100 may determine the number of frequency components to be deleted from the original audio signal 810 according to a speed of the audio object. For example, the audio signal pitch-shifting apparatus 100 may determine 2 as the number of the frequency components to be deleted.

In addition, the audio signal pitch-shifting apparatus 100 may determine an interval between frequency components according to the number of frequency components of an audio signal and the number of frequency components to be deleted. For example, the audio signal pitch-shifting apparatus 100 may determine the interval between the frequency components using Equation 2.

[Equation 2]

$$\text{Frequency interval} = (\text{the number of FFT points}(\text{frequency components}))/(\text{the number of frequency components to be deleted}+1)$$

For example, the audio signal pitch-shifting apparatus 100 may determine 10 / (2 + 1) = 3 as the interval between the frequency components in FIG. 8.

Subsequently, the audio signal pitch-shifting apparatus 100 may determine a position of a frequency component to be deleted from among the frequency components of the audio signal according to the interval between the frequency components. For example, the audio signal pitch-shifting apparatus 100 may determine, as the frequency component to be deleted, a fourth frequency component 811 and an eighth frequency component 812, which are frequency components following three frequency components, so as to maintain 3 which is the interval between the frequency components.

Subsequently, the audio signal pitch-shifting apparatus 100 may delete a frequency component corresponding to the position of the frequency component from among the frequency components of the audio signal.

Finally, the audio signal pitch-shifting apparatus 100 may move frequency components positioned at a right side of the position of the frequency component from among the frequency components of the audio signal to a left side of the position of the frequency component.

In summary, the audio signal pitch-shifting apparatus 100 may determine, as 2, the number of the frequency components to be deleted from the original audio signal 810 according to an increase in the distance between the audio object and the listener. Subsequently, the audio signal pitch-shifting apparatus 100 may determine 3, which is the interval between the frequency components, according to the number of the frequency components of the audio signal and the number of deleted frequency components. Subsequently, the audio signal pitch-shifting apparatus 100 may determine the fourth frequency component 811 and the eighth frequency component 812 as the frequency components to be deleted according to 3 which is the interval between the frequency components. Subsequently, the audio signal pitch-shifting apparatus 100 may delete the fourth frequency component 811 and the eighth frequency component 812 from the original audio signal 810. In addition, the audio signal pitch-shifting apparatus 100 may move each of fifth to seventh frequency components to the left side to fill a position of the fourth frequency component 811. In addition, the audio signal pitch-shifting apparatus 100 may move each of a ninth frequency component and a tenth frequency components to the left side to fill a position of the eighth frequency component 812. Finally, the audio signal pitch-shifting apparatus 100 may set, to 0, values of a ninth frequency component 821 and a tenth frequency component 822 to output the audio signal 820 changed to be in a state in which there is no data.

In the audio signal 820, as data of the ninth frequency component 821 and the tenth frequency component 822 with a highest frequency disappears, a frequency component with a highest frequency may be changed to f(10) to decrease an overall bandwidth.

Figure 9:
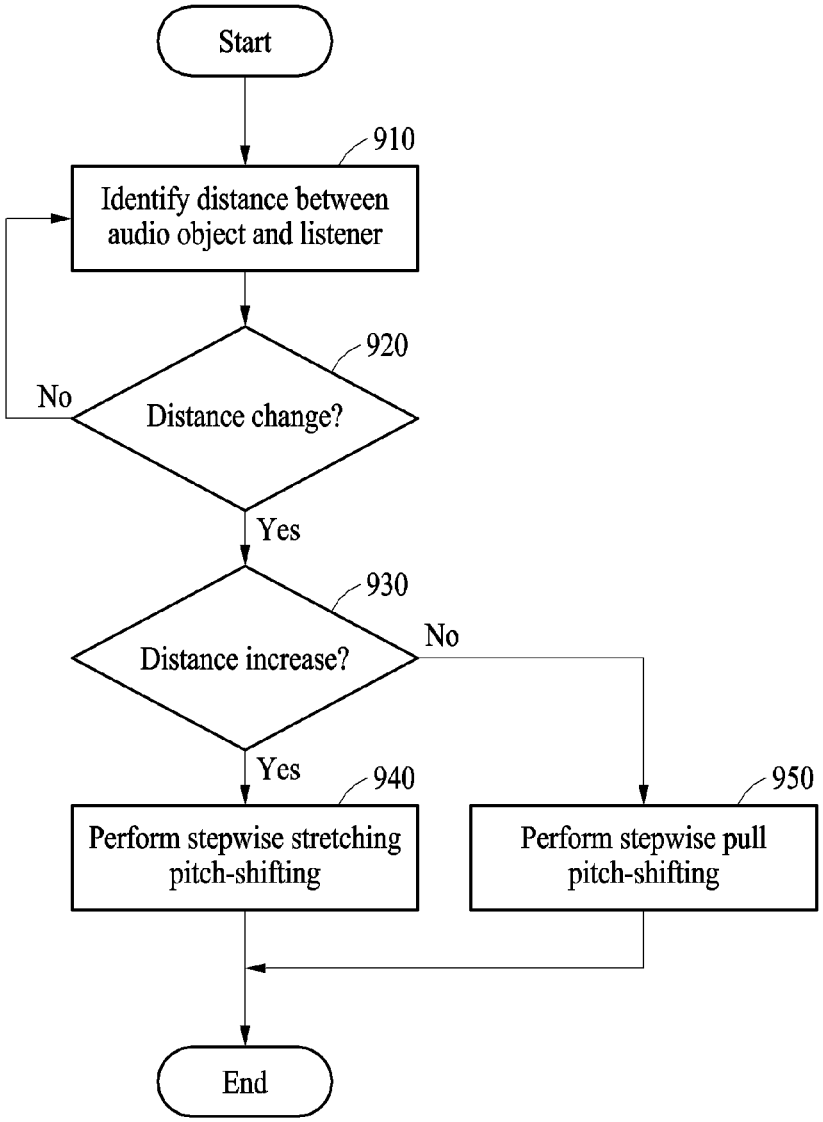
FIG. 9 is a flowchart illustrating a method for pitch-shifting an audio signal according to an example embodiment.

FIG. 9 is a flowchart illustrating a method for pitch-shifting an audio signal according to an example embodiment.

In operation 910, the distance identifier 110 may identify a distance between an audio object included in an audio signal and a listener.

In operation 920, the change identifier 120 may identify whether the distance between the audio object and the listener identified by the distance identifier 110 changes. When the distance between the audio object and the listener changes, the change identifier 120 may perform operation 930. In addition, when the distance between the audio object and the listener does not change, the change identifier 120 may repeatedly perform operations 910 and 920 until the distance between the audio object and the listener changes.

In operation 930, the change identifier 120 may determine whether the distance between the audio object and the listener increases. When the distance between the audio object and the listener decreases, the change identifier 120 may request the stretching pitch shifter 130 to perform operation 940. In addition, when the distance between the audio object and the listener increases, the change identifier 120 may request the pull pitch shifter 130 to perform operation 950.

In operation 940, the stretching pitch shifter 130 may perform stepwise stretching pitch-shifting by repeatedly using at least one of frequency components of the audio signal.

In operation 950, the pull pitch shifter 140 may perform stepwise pull pitch-shifting of deleting at least one of the frequency components of the audio signal.

Figure 10:
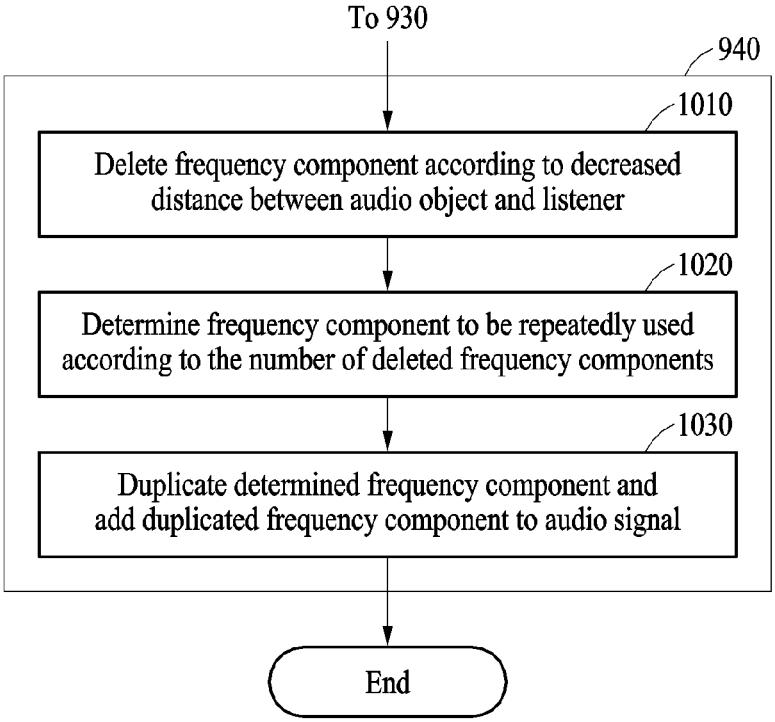
FIG. 10 is a flowchart illustrating a stepwise stretching pitch-shifting process of a method for pitch-shifting an audio signal according to an example embodiment.

FIG. 10 is a flowchart illustrating a stepwise stretching pitch-shifting process of a method for pitch-shifting an audio signal according to an example embodiment. Operations 1010 to 1030 may be included in operation 940 of FIG. 9.

In operation 1010, the stretching pitch shifter 130 may delete at least one of frequency components of the audio signal according to a decreased distance between an audio object and a listener.

In operation 1020, the stretching pitch shifter 130 may determine a frequency component to be repeatedly used according to the number of frequency components deleted in operation 1010. In this case, the stretching pitch shifter 130 may determine an interval between frequency components according to the number of the frequency components of the audio signal and the number of the deleted frequency components. In addition, the stretching pitch shifter 130 may determine the frequency component to be repeatedly used from among the frequency components of the audio signal according to the interval between the frequency components.

In operation 1030, the stretching pitch shifter 130 may duplicate the frequency component determined in operation 1040, and add the duplicated frequency component to the audio signal.

Figure 11:
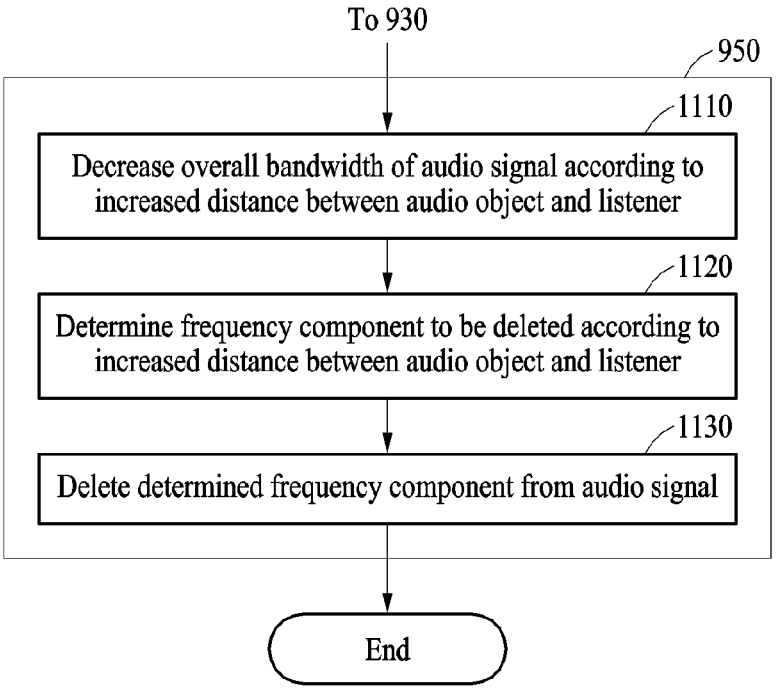
FIG. 11 is a flowchart illustrating a stepwise pull pitch-shifting process of a method for pitch-shifting an audio signal according to an example embodiment.

FIG. 11 is a flowchart illustrating a stepwise pull pitch-shifting process of a method for pitch-shifting an audio signal according to an example embodiment. Operations 1110 to 1130 may be included in operation 950 of FIG. 9.

In operation 1110, the pull pitch shifter 140 may determine the number of frequency components to be deleted from an audio signal according to an increased distance between an audio object and a listener. In this case, an overall bandwidth of the audio signal may be decreased according to the number of the frequency components to be deleted from the audio signal.

In operation 1120, the pull pitch shifter 140 may determine a frequency component to be deleted from the audio signal according to the distance between the audio object and the listener. In this case, the pull pitch shifter 140 may determine an interval between frequency components according to the number of frequency components of the audio signal and the number of frequency components determined in operation 1110. Finally, the pull pitch shifter 140 may determine a position of the frequency component to be deleted from among the frequency components of the audio signal according to the interval between the frequency components.

In operation 1130, the pull pitch shifter 140 may delete the determined frequency component from the audio signal. In this case, the pull pitch shifter 140 may delete a frequency component corresponding to the position of the frequency component from among the frequency components of the audio signal. In addition, the pull pitch shifter 140 may move frequency components positioned at a right side of the position of the frequency component among the frequency components of the audio signal to a left side of the position of the frequency component.

The components described in the example embodiments may be implemented by hardware components including, for example, at least one digital signal processor (DSP), a processor, a controller, an application-specific integrated circuit (ASIC), a programmable logic element, such as a field programmable gate array (FPGA), other electronic devices, or combinations thereof. At least some of the functions or the processes described in the example embodiments may be implemented by software, and the software may be recorded on a recording medium. The components, the functions, and the processes described in the example embodiments may be implemented by a combination of hardware and software.

The method according to example embodiments may be written in a computer-executable program and may be implemented as various recording media such as magnetic storage media, optical reading media, or digital storage media.

Various techniques described herein may be implemented in digital electronic circuitry, computer hardware, firmware, software, or combinations thereof. The techniques may be implemented as a computer program product, i.e., a computer program tangibly embodied in an information carrier, e.g., in a machine-readable storage device (for example, a computer-readable medium) or in a propagated signal, for processing by, or to control an operation of, a data processing apparatus, e.g., a programmable processor, a computer, or multiple computers. A computer program, such as the computer program(s) described above, may be written in any form of a programming language, including compiled or interpreted languages, and may be deployed in any form, including as a stand-alone program or as a module, a component, a subroutine, or other units suitable for use in a computing environment. A computer program may be deployed to be processed on one computer or multiple computers at one site or distributed across multiple sites and interconnected by a communication network.

Processors suitable for processing of a computer program include, by way of example, both general and special purpose microprocessors, and any one or more processors of any kind of digital computer. Generally, a processor will receive instructions and data from a read-only memory or a random-access memory, or both. Elements of a computer may include at least one processor for executing instructions and one or more memory devices for storing instructions and data. Generally, a computer also may include, or be operatively coupled to receive data from or transfer data to, or both, one or more mass storage devices for storing data, e.g., magnetic, magneto-optical disks, or optical disks. Examples of information carriers suitable for embodying computer program instructions and data include semiconductor memory devices, e.g., magnetic media such as hard disks, floppy disks, and magnetic tape, optical media such as compact disk read only memory (CD-ROM) or digital video disks (DVDs), magneto-optical media such as floptical disks, read-only memory (ROM), random-access memory (RAM), flash memory, erasable programmable ROM (EPROM), or electrically erasable programmable ROM (EEPROM). The processor and the memory may be supplemented by, or incorporated in special purpose logic circuitry.

In addition, non-transitory computer-readable media may be any available media that may be accessed by a computer and may include both computer storage media and transmission media.

Although the present specification includes details of a plurality of specific example embodiments, the details should not be construed as limiting any invention or a scope that can be claimed, but rather should be construed as being descriptions of features that may be peculiar to specific example embodiments of specific inventions. Specific features described in the present specification in the context of individual example embodiments may be combined and implemented in a single example embodiment. On the contrary, various features described in the context of a single embodiment may be implemented in a plurality of example embodiments individually or in any appropriate sub-combination. Furthermore, although features may operate in a specific combination and may be initially depicted as being claimed, one or more features of a claimed combination may be excluded from the combination in some cases, and the claimed combination may be changed into a sub-combination or a modification of the sub-combination.

Likewise, although operations are depicted in a specific order in the drawings, it should not be understood that the operations must be performed in the depicted specific order or sequential order or all the shown operations must be performed in order to obtain a preferred result. In a specific case, multitasking and parallel processing may be advantageous. In addition, it should not be understood that the separation of various device components of the aforementioned example embodiments is required for all the example embodiments, and it should be understood that the aforementioned program components and apparatuses may be integrated into a single software product or packaged into multiple software products.

The example embodiments disclosed in the present specification and the drawings are intended merely to present specific examples in order to aid in understanding of the present disclosure, but are not intended to limit the scope of the present disclosure. It will be apparent to those skilled in the art that various modifications based on the technical spirit of the present disclosure, as well as the disclosed example embodiments, can be made.

What is claimed is:

1. A method for pitch-shifting an audio signal, the method comprising:

identifying a distance between an audio object included in the audio signal and a listener;

checking whether the distance between the audio object and the listener decreases; and performing stepwise stretching pitch-shifting of repeatedly using at least one of frequency components of the audio signal when the distance between the audio object and the listener decreases.

2. The method of claim 1, wherein the performing of the stepwise stretching pitch-shifting comprises:

deleting at least one of the frequency components of the audio signal according to the decreased distance between the audio object and the listener;

determining a frequency component to be repeatedly used according to the number of deleted frequency components; and duplicating the frequency component to be used repeatedly and adding the duplicated frequency component.

3. The method of claim 2, wherein the determining of the frequency component to be repeatedly used comprises:

determining an interval between frequency components according to the number of the frequency components of the audio signal and the number of the deleted frequency components; and determining a frequency component to be repeatedly used from among the frequency components of the audio signal according to the interval between the frequency components.

4. A method for pitch-shifting an audio signal, the method comprising:

identifying a distance between an audio object included in the audio signal and a listener;

checking whether the distance between the audio object and the listener increases; and performing stepwise pull pitch-shifting of deleting at least one of frequency components of the audio signal when the distance between the audio object and the listener increases.

5. The method of claim 4, wherein the performing of the stepwise pull pitch-shifting comprises:

determining a frequency component to be deleted from the audio signal according to the distance between the audio object and the listener; and deleting the determined frequency component from the audio signal.

6. The method of claim 5, wherein the determining of the frequency component to be deleted comprises:

determining the number of frequency components to be deleted from the audio signal according to the increased distance between the audio object and the listener;

determining an interval between frequency components according to the number of the frequency components of the audio signal and the number of the frequency components to be deleted; and determining a position of a frequency component to be deleted from among the frequency components of the audio signal according to the interval between the frequency components.

7. The method of claim 5, wherein the deleting of the frequency component comprises:

deleting a frequency component corresponding to a position of the frequency component from among the frequency components of the audio signal; and moving frequency components positioned at a right side of the position of the frequency component from among the frequency components of the audio signal to a left side of the position of the frequency component.

8. An apparatus for pitch-shifting an audio signal, the apparatus comprising:

a distance identifier configured to identify a distance between an audio object included in the audio signal and a listener;

a change identifier configured to identify whether the distance between the audio object and the listener changes;

a stretching pitch shifter configured to perform stepwise stretching pitch-shifting of repeatedly using at least one of frequency components of the audio signal when the distance between the audio object and the listener decreases; and a pull pitch shifter configured to perform stepwise pull pitch-shifting of deleting at least one of the frequency components of the audio signal when the distance between the audio object and the listener increases.

9. The apparatus of claim 8, wherein the stretching pitch shifter is configured to:

delete at least one of the frequency components of the audio signal according to the decreased distance between the audio object and the listener;

determine a frequency component to be repeatedly used according to the number of deleted frequency components; and duplicate the determined frequency component and add the duplicated frequency component to the audio signal.

10. The apparatus of claim 9, wherein the stretching pitch shifter is configured to:

determine an interval between frequency components according to the number of the frequency components of the audio signal and the number of the deleted frequency components; and determine a frequency component to be repeatedly used from among the frequency components of the audio signal according to the interval between the frequency components.

11. The apparatus of claim 8, wherein the pull pitch shifter is configured to:

decrease an overall bandwidth of the audio signal according to the increased distance between the audio object and the listener;

determine a frequency component to be deleted from the audio signal according to the distance between the audio object and the listener; and delete the determined frequency component from the audio signal.

12. The apparatus of claim 11, wherein the pull pitch shifter is configured to:

determine the number of frequency components to be deleted from the audio signal according to the increased distance between the audio object and the listener;

determine an interval between frequency components according to the number of the frequency components of the audio signal and the number of the frequency components to be deleted; and determine a position of a frequency component to be deleted from among the frequency components of the audio signal according to the interval between the frequency components.

13. The apparatus of claim 11, wherein the pull pitch shifter is configured to:

delete a frequency component corresponding to a position of the frequency component from among the frequency components of the audio signal; and move frequency components positioned at a right side of the position of the frequency component from among the frequency components of the audio signal to a left side of the position of the frequency component.

* * * * *